US006428351B1

(12) United States Patent
Turner et al.

(10) Patent No.: US 6,428,351 B1
(45) Date of Patent: Aug. 6, 2002

(54) MODULAR AUDIO/POWER CONNECTOR SYSTEM

(76) Inventors: Mark Turner, 10363 E. HJ Ave., Galesburg, MI (US) 49053; Tim Kleis, 8141 N. 26th St., Kalamazoo, MI (US) 49004

( * ) Notice: Subject to any disclaimer, the term of this patent is extended or adjusted under 35 U.S.C. 154(b) by 0 days.

(21) Appl. No.: 09/934,898

(22) Filed: Aug. 22, 2001

(51) Int. Cl.[7] ..... H01R 13/60; H01R 13/66; H01R 13/502; H01R 13/514

(52) U.S. Cl. ..... 439/540.1; 439/701; 439/569

(58) Field of Search ..... 439/540.1, 532, 439/713, 544, 701, 569

(56) References Cited

U.S. PATENT DOCUMENTS

| | | | | | |
|---|---|---|---|---|---|
| 4,367,513 | A | | 1/1983 | Cronin | |
| 4,669,799 | A | * | 6/1987 | Vachhani et al. | 439/404 |
| 4,829,564 | A | * | 5/1989 | Jarvis | 379/327 |
| 4,993,970 | A | | 2/1991 | Littrell | |
| 5,055,067 | A | * | 10/1991 | Field | 439/540.1 |
| 5,129,842 | A | * | 7/1992 | Morgan et al. | 439/532 |
| 5,161,997 | A | * | 11/1992 | Defibaugh et al. | 248/222.51 |
| 5,263,876 | A | | 11/1993 | Johnescu et al. | |
| 5,411,416 | A | * | 5/1995 | Balon et al. | 439/540.1 |
| 5,492,478 | A | * | 2/1996 | White | 439/151 |
| 5,508,891 | A | | 4/1996 | Rowe et al. | |
| 5,528,453 | A | | 6/1996 | Berman et al. | |
| 5,531,612 | A | * | 7/1996 | Goodall et al. | 439/541.5 |
| 5,658,166 | A | * | 8/1997 | Freeman et al. | 439/49 |
| 5,989,074 | A | * | 11/1999 | Miller et al. | 439/540.1 |
| 6,086,415 | A | * | 7/2000 | Sanchez et al. | 439/532 |
| 6,193,563 | B1 | * | 2/2001 | Yagi et al. | 439/372 |
| 6,273,752 | B1 | * | 8/2001 | Martin et al. | 439/540.1 |

* cited by examiner

*Primary Examiner*—P. Austin Bradley
*Assistant Examiner*—Edwin A. León
(74) *Attorney, Agent, or Firm*—Flynn, Thiel, Boutell & Tanis, P.C.

(57) ABSTRACT

A modular plug connector system for connection to audio, video, power and other telecommunication plugs is provided which includes a plurality of single-port and multi-port connector blocks which are mountable to an equipment rack and allow for the selected arrangement of plug connectors on the equipment rack. The connector blocks also are arrangeable into a kit comprising a variety of single-port and multi-port connector blocks.

20 Claims, 14 Drawing Sheets

MODULAR AUDIO/POWER CONNECTOR SYSTEM

FIELD OF THE INVENTION

The invention relates to an audio connector system and more particularly, to a modular electrical connector system having audio, power and/or video plug connectors which are mountable to an equipment rack.

BACKGROUND OF THE INVENTION

It is known to provide equipment racks for supporting various connectors of a sound system such as a transportable speaker system. Such equipment racks may include horizontal rails with a row of openings to which the audio/power/video plug connectors are mounted. The audio connectors are selectively mounted to the mounting holes depending upon the requirements of the sound system.

However, while it is known to mount a specific audio connector to the mounting rail and then connecting audio cabling to the connector, such an arrangement may not provide suitable protection to the mechanical connection between the wire and the connector.

It is an object of the invention to provide an improved audio/power/video plug connector system which eliminates disadvantages associated with conventional audio connector systems.

More particularly, the invention relates to a modular audio/power/video connector system having a variety of single- and multi-port connector blocks to which the plug connectors and cabling are fixedly connected. These connector blocks physically protect and isolate the mechanical connection between the connectors and the cabling. Additionally, the connector blocks are formed of a modular size so that multiple connector blocks can be connected to a single mounting rail of an equipment rack. For a multi-port connector block, the modular width of this connector block corresponds to a multiple of a single connector block so that a multi-port connector block can readily fit between different size connector blocks on a single mounting rail or be replaced with one or more alternate connector blocks.

More particularly, in a single-port connector block, a single connector port is provided for mounting the audio/power/video connector to the connector block. Additionally, a single fitting port is provided for passage of the cabling into the connector block whereby a cable fitting is mounted to the fitting port to provide a physically secure connection between the block and cabling to thereby protect the mechanical connection between the connector and the cabling.

In alternate embodiments of the system, a connector block may be provided with multiple connector ports and a lesser number of fitting ports whereby a fitting port is in open communication internally with a plurality of connector ports. More specifically, one of these connector blocks may have a single row of connector ports and a single fitting port which communicates with all of the connector ports through an elongate interior bore within the connector block.

Additionally, a splice-type connector block also may be provided wherein one face of the connector block includes multiple fitting ports and another face of the connector block has a single fitting port. As such, individual cables may be routed into the connector block through the multi-port face, while a combined bundle of cables exit the connector block through the single fitting port.

The invention furthermore relates to a kit of the above-described connector blocks which kit can be modified and adapted to the specific arrangement required in an audio system. For example, a typical kit would include a plurality of connector blocks of various types i.e. a combination of single- and multi-port connector blocks and splice blocks. These connector blocks can be connected either to an existing mounting rail of an equipment rack or by additional mounting rails which comprise part of the kit. The kit also typically includes a plurality of compression fittings which fit into the fitting ports, the fitting ports preferably being internally threaded to receive the compression fittings. Additionally, the audio connectors may be provided as part of the kit or obtained separately through electrical supply houses.

The connector blocks also include mounting parts such as fastener bores near the connector ports to permit fixed connection of the connectors thereto and to permit the rigid connection of the connector block to the mounting rail. Each connector block also can be provided with additional mounting parts thereon that allow the connector block to be mounted in alternate locations such as directly to a building component or furniture within the building.

Other objects and purposes of the invention, and variations thereof, will be apparent upon reading the following specification and inspecting the accompanying drawings.

Figures 1, 2, 3:
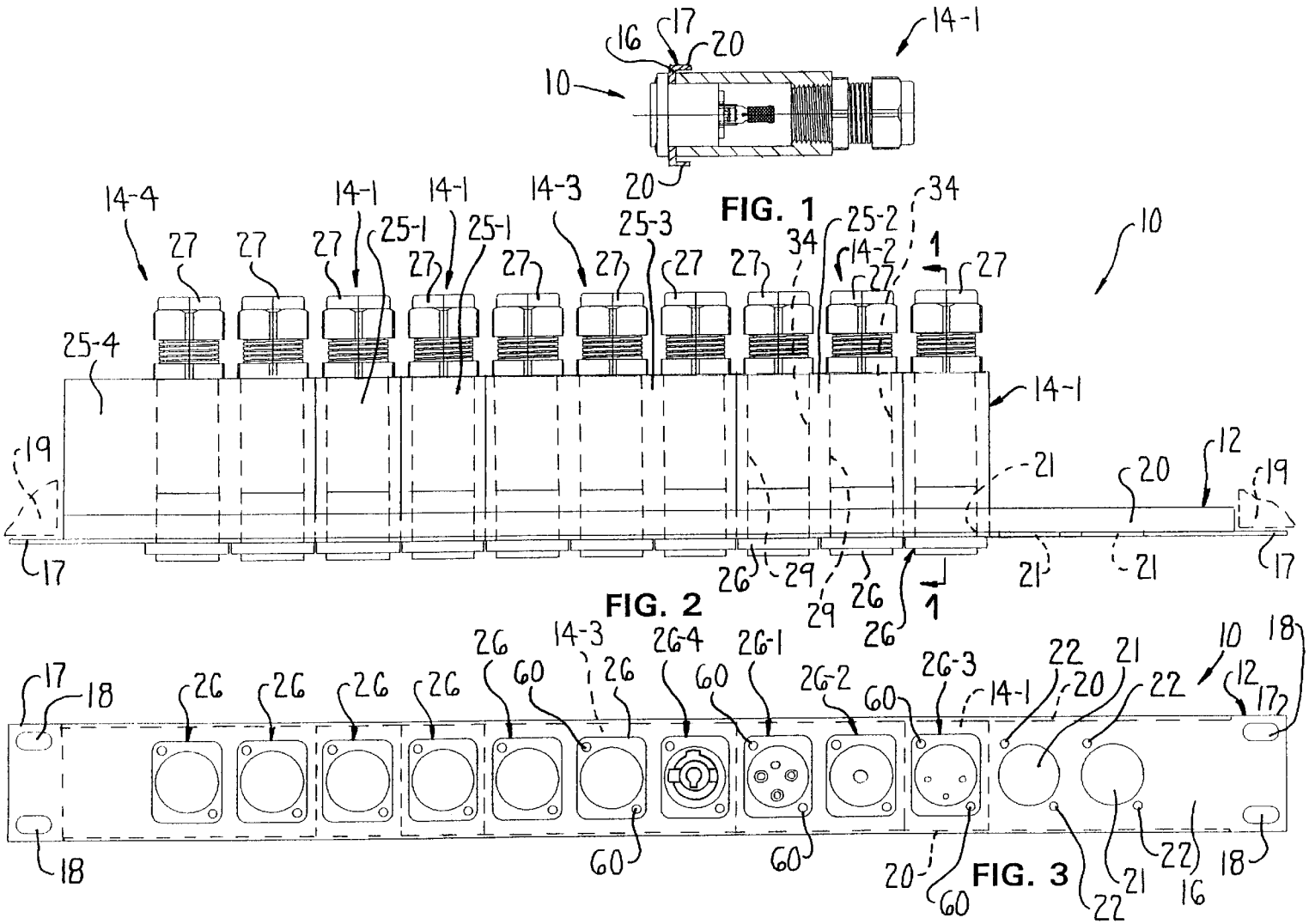
FIG. 1 is a side cross-sectional view of a modular connector assembly mounted to a mounting rail, for example, of an equipment rack as taken along line 1—1 of FIG. 2.
FIG. 2 is a plan view of a plurality of single-, double- and triple-port connector block assemblies mounted to the mounting rail.
FIG. 3 is a front elevational view of the connector block arrangement of FIG. 2.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1–3, the invention relates to a modular plug connector system 10 which includes a mounting rail 12, such as on an audio equipment rack, and a plurality of connector block assemblies 14 (14-1, 14-2, 14-3, 14-4), which connector block assemblies 14 have modular widths and are removably secured to the mounting rail 12.

The mounting rail 12 is horizontally elongate and has a planar front wall 16 which typically faces forwardly in use. The front wall includes mounting flanges 17 at the opposite ends thereof wherein the mounting flanges 17 include pairs of fastener slots 18. The mounting rail 12 is adapted to be fixedly secured to any rigid support structure 19, the rigid structure being diagrammatically illustrated in phantom outline in FIG. 2. The support structure 19, for example, may be an equipment rack, existing furniture or even a building frame. Specifically, the fastener slots 18 are adapted to receive fasteners therethrough, which said fasteners are fixed to the support structure 19.

The mounting rail 12 further includes first and second horizontally elongate flanges 20 along the upper and lower edges of the front wall 16. The flanges extend rearwardly away from the front wall 16, generally at a right angle relative thereto.

Additionally, the mounting rail 12 includes a row of mounting holes 21 which are laterally spaced apart from each other at substantially equal distances. As illustrated in FIG. 3, the two right-most holes 21 are unused and thereby define openings which project through the entire thickness of the front wall 16. The front wall 16 also includes a pair of smaller fastener holes 22 adjacent to each opening 21. The fastener holes 22 in particular are located on diagonally opposite sides of the respective opening 21 and are provided to permit rigid connection of each of the connector block assemblies 14 to the front rail wall 16.

Relative to the following discussion, it will be understood that the reference numeral 14 designates any of the connector block assemblies, and further reference numerals 14-1, 14-2, etc. are used to differentiate the embodiments of connector block assemblies one from the other. This convention is also used to designate other common parts which are similar but not identical in structure.

It will be understood that while the mounting rail 12 during normal use extends horizontally and the openings 21 open forwardly therefrom, the mounting rail 12 also can be secured in place in different orientations whereby the mounting rail 12, for example, extends horizontally but faces upwardly, or alternatively extends vertically and faces either forwardly or sidewardly.

Figure 4:
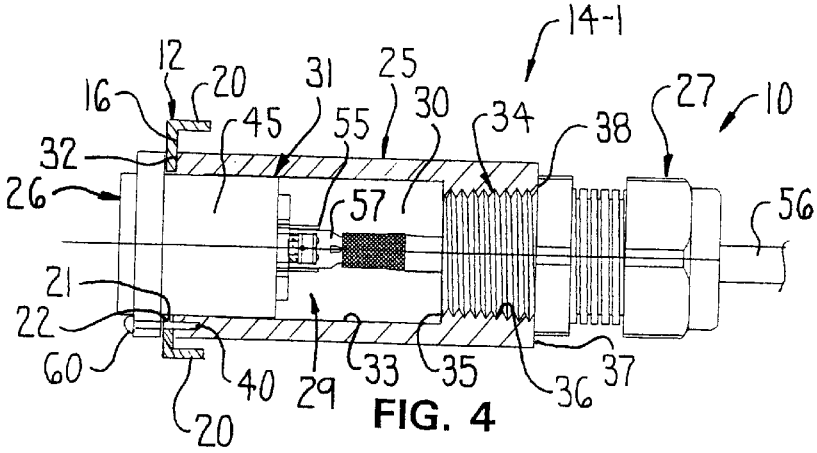
FIG. 4 is an enlarged side elevational view of the connector block arrangement of FIG. 1.

More particularly as to the connector block assemblies 14, each of the connector block assemblies 14 includes a connector block 25 (FIG. 4), at least one audio power or video plug-type connector 26 and at least one cable fitting 27. The connector block assembly 14-1 is mountable to the mounting rail 12 wherein the connector 26 is accessible from a front side of the front rail wall 16 while the cable fitting 27 is disposed on a rear side of the mounting rail 12. While FIG. 4 generally identifies the connector block assembly therein by reference numeral 14-1, it will be understood that the cross-sectional view of FIG. 4 is the same for the alternate connector block assemblies 14-2, 14-3 and 14-4. Therefore, while the following discussion of FIGS. 5 and 6 primarily is applicable to the connector block assembly 14-1, this discussion is equally applicable to the multi-port connector block assemblies 14-2, 14-3 and 14-4.

Figure 6:
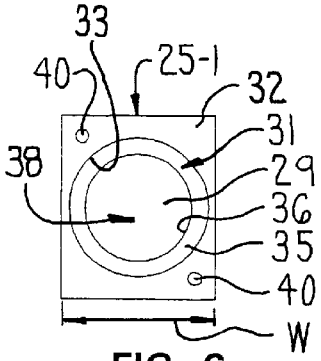
FIG. 6 is a front elevational view of the connector block.
Figure 5:
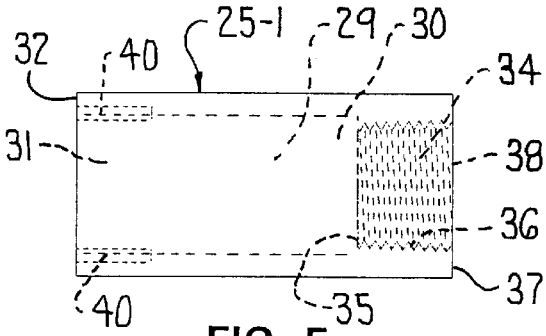
FIG. 5 is a side elevational view of a connector block.

Referring to FIGS. 5 and 6, a single-port connector block 25-1 is illustrated. The connector block 25-1 is formed of a block of a suitable non-conductive, relatively rigid plastic material formed in a rectangular shape having a modular width W (FIG. 6). The connector block 25-1 has an elongate cylindrical bore 29 which extends a partial distance into the interior of the connector block 25-1. The bore 29 has an inner end which defines an interior chamber 30 and a connector port 31 at an exterior end thereof. The connector port 31 opens through an outer face 32 of the connector block 25-1 and defines a socket into which the connector 26 is received as described hereinafter in further detail. The bore 29 is defined circumferentially by an interior bore surface 33.

Additionally, the connector block 25-1 includes a fitting bore 34 which is aligned coaxially with the connector bore 29 and is in direct open communication therewith. The fitting bore 34 has a reduced diameter relative to the connector bore 29 such that a shoulder 35 is defined at the interface between the connector bore 29 and the fitting bore 34. Preferably, the fitting bore 34 has a threaded interior surface 36 and opens rearwardly from a back block face 37 to thereby define a fitting port 38.

The connector block 25-1 further includes a pair of fastener bores 40 which are disposed at diagonally opposite corners of the connector block 25-1. The fastener bores 40 are located so as to be in registry with the fastener holes 22 formed in the mounting rail 12. While the fastener bores 40 will receive threaded fasteners therein, it is not necessary to tap the bores 40 since the plastic material allows for self-tapping of the bores 40 by suitable fasteners. When the fastener bores 40 and the holes 22 of the mounting rail 12 are aligned with each other, the connector opening 21 in the mounting rail 12 is coaxially aligned with the connector bore 29, wherein the connector bore 29 has a diameter which is substantially equal to the diameter of the connector opening 21.

Figure 8:
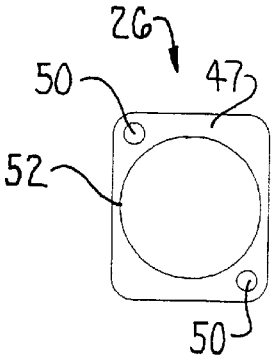
FIG. 8 is a front elevational view of the audio connector.
Figure 7:
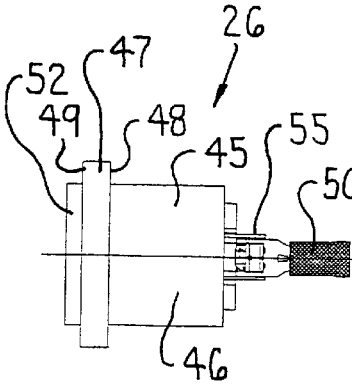
FIG. 7 is a side elevational view of a representative audio connector.

Referring to FIGS. 7 and 8, the audio/power/video plug connector 26 is adapted to be slidably received within the open end of the connector port 31 as illustrated in FIG. 4. The term "audio/power/video" as used herein shall primarily mean either audio, power or video although it is possible a connector 26 may have any combination of these capabilities. Further, such connectors 26 typically accommodate electrical current but may alternatively accommodate fiber optics. Referring to FIG. 3, the audio/power connector 26 may be one of many conventional audio or power plug connectors which are commercially available. For example as illustrated in FIG. 3, three different types of audio connectors are illustrated therein and designated by reference numerals 26-1, 26-2 and 26-3. These audio connectors have substantially the same construction except that they are adapted to mate with or connect externally to different types of audio, video or power plugs and the like. For example, audio connector 26-1 is a female-type connector adapted to receive the prongs of a three-prong audio connector plug. The audio connector 26-2 is a single-prong receptacle which may also handle video, while audio connector 26-3 has three prongs disposed within the hollow interior to thereby define a male-type connector.

Additionally, the connector 26 may be a power connector such as the connector designated by reference numeral 26-4. This power connector 26-4 is of the type typically used on audio equipment racks such as, for example, a coupler sold by Neutrik.

The remaining connectors 26 of FIG. 3 are diagrammatically illustrated wherein details as to the specific prong or receptacle opening feature are omitted since the specific arrangement of each audio/power/video connector 26 can be varied depending upon the specific requirements of the audio system. Therefore, these audio/power/video connectors 26 may be of any type so long as the connector 26 is sized to fit within the opening 21 and has a mounting arrangement which is usable with the mounting holes 22 in the mounting rail 12. It will be understood, however, that the mounting hole arrangement could be modified to conform to a different connector mounting arrangement such as by adding mounting holes in the mounting rail 12.

More particularly as to FIGS. 7 and 8, the representative connector 26 has a cylindrical housing 45 defined by an outer circumferential surface 46. The front end of the connector housing 45 includes a rectangular mounting flange 47 which projects radially outwardly from the circumferential surface 46. The mounting flange 47 is defined by a rear face 48 and a front face 49, and includes at least two flange holes 50 disposed at diagonally opposite corners of the mounting flange 47.

The circumferential surface 46 has a diameter which corresponds to the diameter of the rail hole 21 and the connector port 31 as described in further detail herein. The diameter of the circumferential surface 46 thereby allows the connector 26 to be inserted through the opening 21 into engagement with the connector port 31. Preferably, the connector housing 45 is slightly spaced from the rail opening 21 to permit easy sliding of the connector housing 45 rearwardly therethrough as seen in FIG. 4, but the housing 45 is dimensioned so as to be tight-fittingly received within the connector port 31. This arrangement is discussed in further detail hereinafter.

The connector 26 further includes a connector end portion 52 which projects forwardly from the front face 49 of the mounting flange 47. The connector end portion 52 is provided with suitable male or female electrical connectors as described above with respect to the audio connectors 26-1, 26-2 or 26-3. It is understood that alternate types or different combinations of male and/or female connector parts may be provided in the connector end portion 52.

The connector 26 further includes a cabling terminal 55 which projects rearwardly from the back end of the housing 45 for connection to wires or cabling 56. The distal end of the cabling 56 is illustrated in FIG. 7 while a length of the cabling 56 is illustrated in FIG. 4. The cabling terminal 55 has a conventional construction which permits ready connection of the cabling 56 thereto. For example, the cabling 56 is mechanically connected to the cabling terminal 55 by conventional techniques such as soldering or a quick connect snap-on connector 57. Further disclosure as to the connection between the cabling 56 and the terminal 55 is not required for an understanding of the invention disclosed herein.

Figure 9:
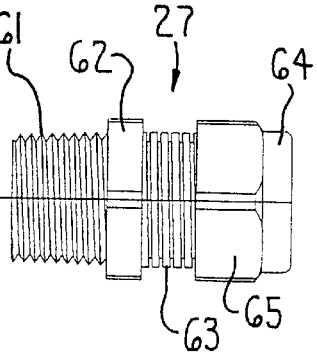
FIG. 9 is a side elevational view of a compression fitting.

Referring to FIG. 9, the cable fitting 27 is a compression fitting. The cable fitting 27 includes a threaded male end 61 which has external threads that mate with and screw into the threaded fitting port 38 as seen in FIG. 4. The cable fitting 27 also includes an annular hex flange 62 which allows for a wrench or the like to be used to tight-fittingly thread the male end 61 into the fitting port 38. The outer end of the cable fitting 27 includes axially-extending, circumferentially-separated fingers and an external threaded section 63 which is disposed outwardly of the hex flange 62. An annular compression collar 64 is internally threaded so as to threadedly engage the threaded section 63. The compression collar 64 has a hexagonal shape as defined by the hex faces 65 which allows a tool to be used to thread the compression collar 64 onto the thread 63 and thereby drive the fingers radially inwardly to grip the cabling 56 in a manner used conventionally in compression fittings of this type.

The compression fitting 27 has an elongate bore extending axially therethrough which allows the cable 56 to pass through the hollow interior of the cable fitting 27 and thereby extend into the interior chamber 30 of the connector block 25. When the compression collar 64 is tightened, the fingers are moved radially inwardly to tight-fittingly grip the cabling 56 and define a fixed connection therebetween.

Referring to FIG. 4, mounting of the connector block assembly 14 to the mounting rail 12 is readily accomplished by the interconnection of the audio connector 26 to the connector block 25. More particularly, the audio connector 26 is first engaged with the mounting rail 12 by inserting the connector housing 45 rearwardly through the rail opening 21. Thereafter, the cabling 56 is inserted through the cable fitting 27 and then inserted into the fitting port 38. Since the cable fitting 27 is not yet fixedly connected to cabling 56, the connector block 25 and the cable fitting 27 can be slid rearwardly away from the cable plug 57 so that the terminal 55 on the audio connector 26 is exposed. The cable plug 55 is fixedly connected to the terminal 55 so that the cabling 56 is now electrically connected to the connector 26. Thereafter, the connector block 25 is slid forwardly until the connector housing 45 is fitted into the open end of the connector port 31. As a result, the front wall 16 of the mounting rail 12 is clamped between the back face 48 of the connector mounting flange 47 and the opposing front face 32 of the connector block 25. In this arrangement, all of the flange holes 50, rail holes 22 and connector block fastener bores 40 are coaxially aligned such that threaded fasteners 60 can be threaded rearwardly therethrough to fix the audio connector 26 to the connector block 25 as seen in FIG. 4.

In this arrangement, the connector block assembly 14 is fixedly supported on the mounting rail 12 while the mechanical connection between the cable plug 57 and the connector terminal 55 is confined entirely within the interior chamber 30 of the connector block 25. This mechanical connection thereby is protected and isolated therein.

Referring to FIG. 2, it can be seen that a single-port connector block assembly 14-1 includes a single connector 26 at one end thereof and a single cable fitting 27 at the opposite end thereof. In a double-port connector block assembly 14-2, the width of the connector block 25-2 is double the width W of a single width connector block 25-1 so that the overall width of the connector block 25-2 is modular relative to the modular single width W of the single connector block 25-1.

The connector block 25-2 is provided with two parallel bores 29 therein which each communicate with a respective fitting bore 34. Each of the connector bores 29 receives a corresponding connector 26 therein in a manner identical to that of the single-port connector block 14-1. Further, each fitting bore 34 of the double-port connector block 25-2 also threadedly receives a respective cable fitting 27 in a manner identical to that of the single-port connector block 25-1 of FIG. 4 such that further discussion as to the mounting of the connectors 26 and the cable fittings 27 is not required.

As to the triple-port connector block assembly 14-3, this also is formed substantially identical to the connector block assemblies 14-1 and 14-2 discussed above except that the modular width of the triple-port connector block assembly 14-3 is substantially equal to three times the width W.

As to the connector block assembly 14-4 of FIG. 2, this connector block assembly 14-4 is substantially the same as the connector block assembly 14-2 in that two audio connectors 26 and two cable fittings 27 are provided thereon. However, the connector block assembly 14-4 has an asymmetric shape and an increased width compared to the connector block assembly 14-2.

Figure 10:
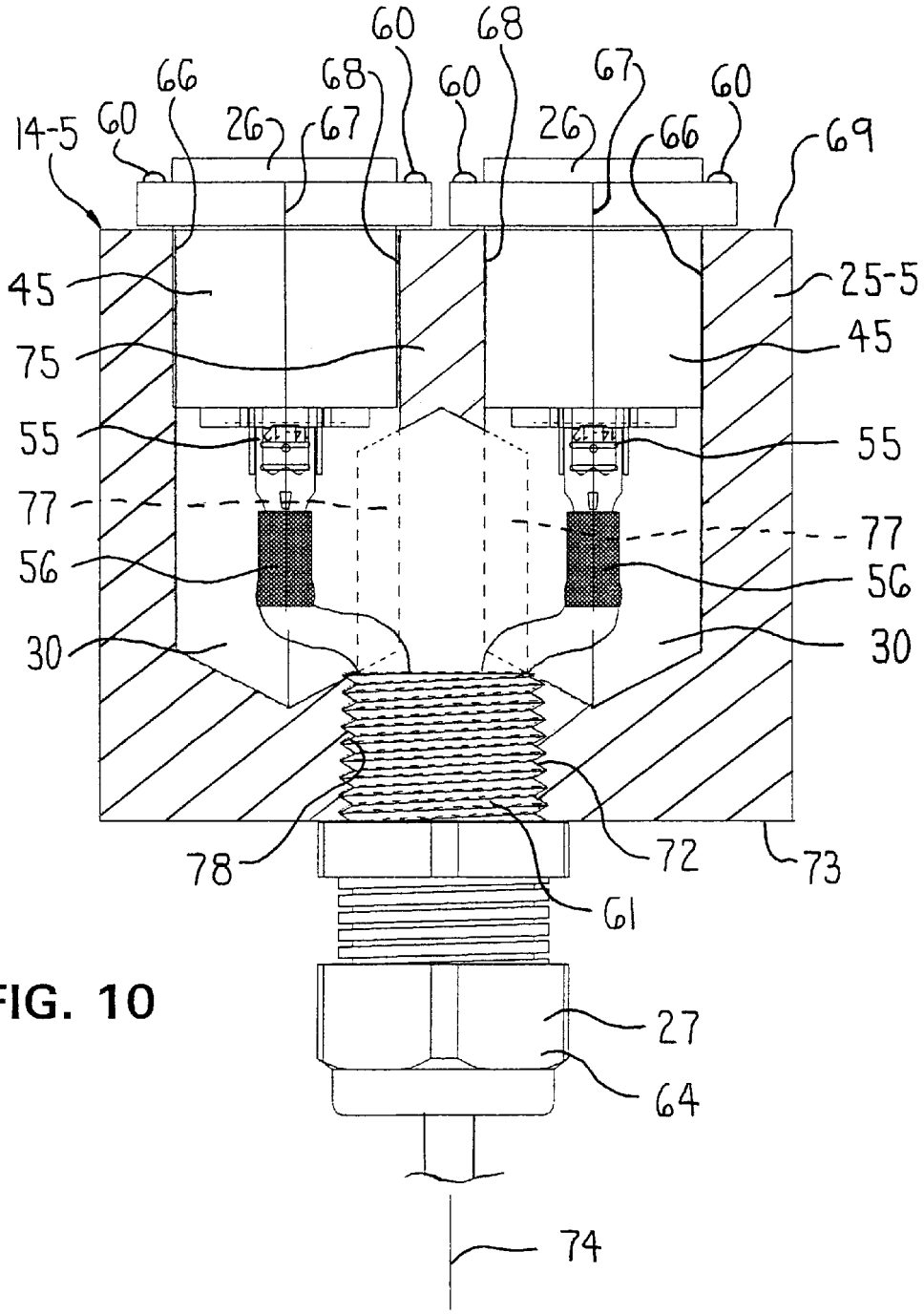
FIG. 10 is a cross-sectional plan view of a second double-port connector block assembly having two connector ports and a single fitting port.
Figure 13:
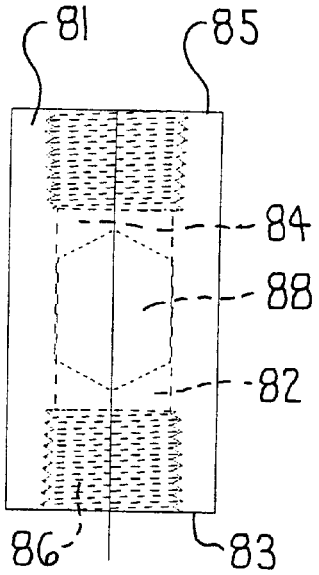
FIG. 13 is a side elevational view of the splice type connector block.
Figure 11:
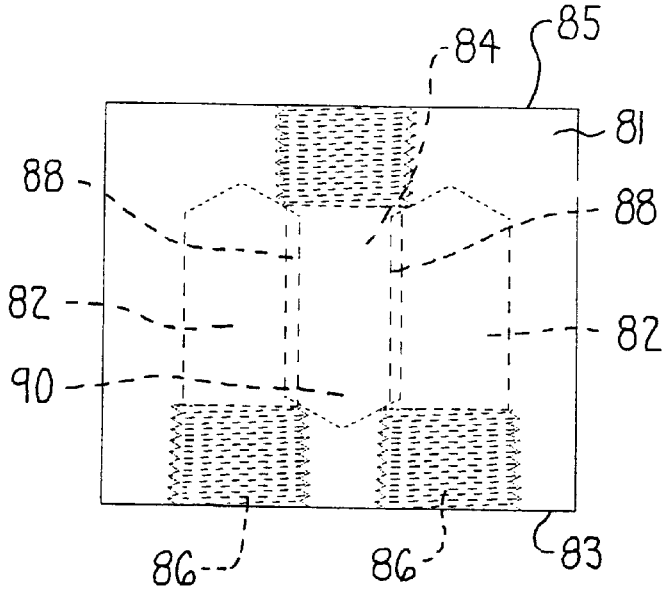
FIG. 11 is a plan view of a splice type of connector block.
Figure 12:
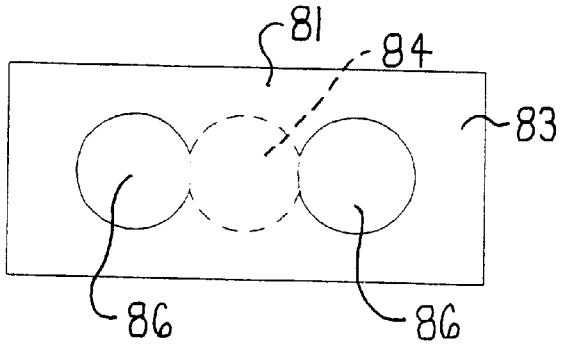
FIG. 12 is a front elevational view of the splice type connector block of FIG. 11.
Figure 14:
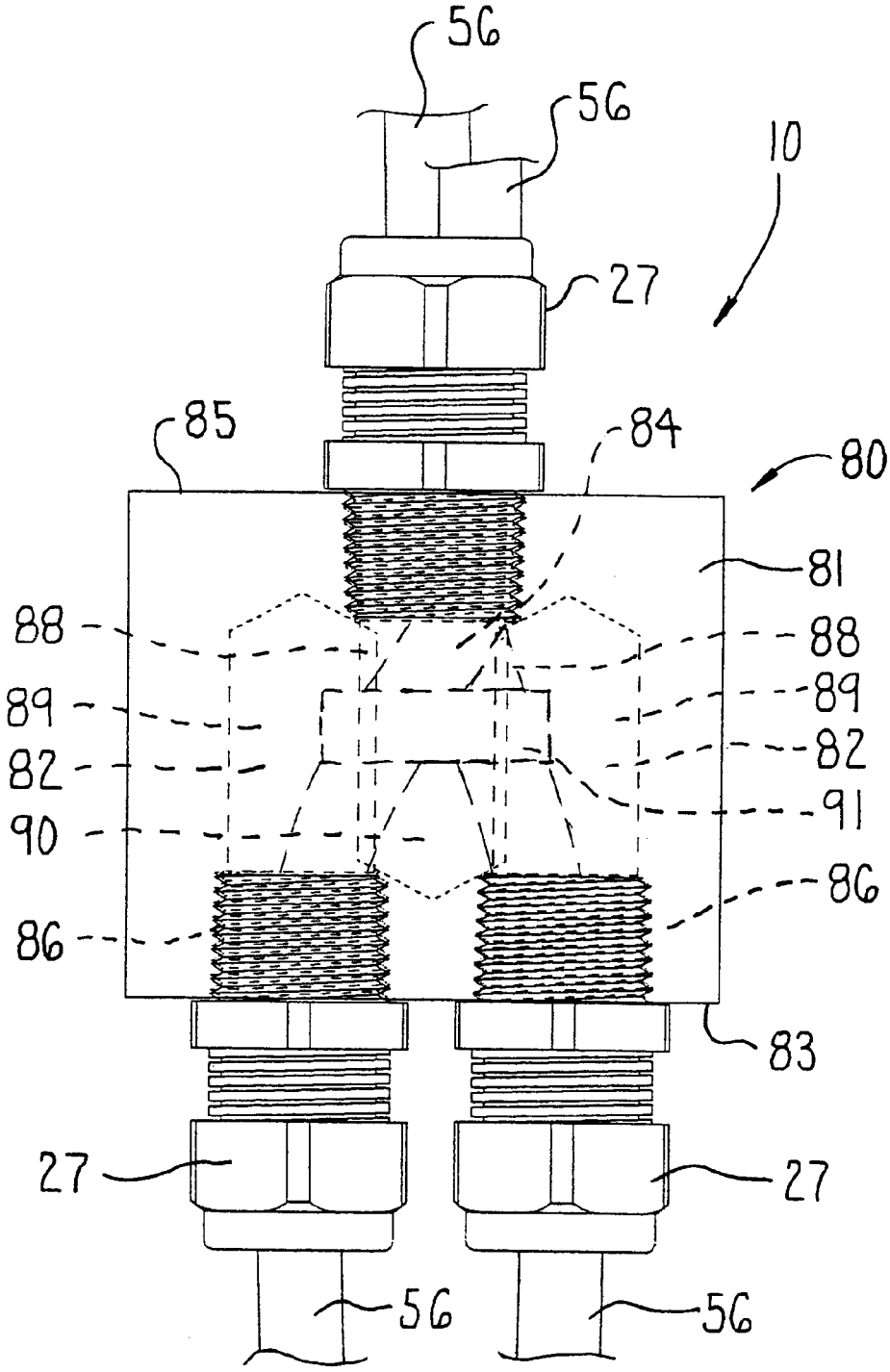
FIG. 14 is a plan view of a splice type connector block assembly illustrating cabling extending therethrough.

The above-described connector block assemblies 14-1, 14-2, 14-3 and 14-4 are substantially similar to each other in that each connector 26 has a single cable fitting 27 corresponding thereto, wherein cabling 56 connected to the connector 26 is isolated from the cabling 56 of an adjacent connector 26, whether the adjacent connector 26 is defined by another connector block assembly 14 or is formed in the same connector block assembly such as in a double-port connector block assembly 14-2. However, as illustrated in FIG. 10, a connector block assembly 14-5 may be provided wherein a plurality of connectors 26 may be provided which correspond a common single cable fitting 27. In this connector block assembly 14-5, the connectors 26 and the cable fitting 27 are formed identical to those disclosed above and thus, further discussion as to the connectors 26, the cable fitting 27 and the connection of cabling 56 to the housing terminals 55 is not required herein.

The primary difference in the construction of the connector block assembly 14-5 is in the formation of the connector block 25-5. The connector block 25-5 is formed similar to the double-port connector block 25-2 in that the width of the connector block 25-5 is substantially equal to twice the width W. The connector block 25-5 is formed of the same insulative plastic material and has a generally rectangular shape.

The connector block 25-5 is formed with a pair of bores 66 which extend rearwardly in substantially parallel relation. The axes 67 of the bores 66 are sidewardly spaced apart so that the bores 66 are aligned in registry with a corresponding pair of rail openings 21. Each bore 66 defines a connector port 68 which opens outwardly from the front face 69 of the connector block 25-5 and is adapted to tight-fittingly receive the connector housing 45 therein. The connector block 25-5 also includes two pairs of fastener bores in the front face 69. Each pair of fastener bores is disposed on diagonally opposite sides of a respective connector port 68 in substantially the same position as the fastener bores 40 relative to the connector port 31. As such, the connectors 26 can be fixedly attached to the connector block 25-5 by fasteners 60 which pass through the flange openings 50 of the connector 26 and engage the fastener bores in the connector block 25-5.

As seen in FIG. 10, the connector block 25-5 may be used separately of the mounting rail 12 whereby the connectors 26 can be fixedly secured directly to the connector block 25-5. It will also be understood that the connector block assemblies 14-1, 14-2, 14-3 and 14-4 also can be used separate of the connector rail 12 whereby the connectors 26 would be fastened directly to and abut against the front face 32 of each connector block in a manner similar to that illustrated in FIG. 10. Alternatively, the connector block assembly 14-5 also can be connected to the mounting rail 12 through the same arrangement as seen in FIG. 4 wherein the front wall of the mounting rail 12 would be clamped between the connector 26 and the front face 69 of the connector block 25-5.

To permit connection of cabling 56 to the connectors 26, the bores 66 further extend rearwardly past the end of the connector housing 45 to thereby each define an interior chamber 30 in which the connection of the cabling 56 and the terminals 55 is accomplished. As illustrated in FIG. 10, the bores 66 preferably are formed by drilling rearwardly into the block such that the bores 66 have conical end portions which conform to the shape of a drill bit.

The connector block 25-5 further includes a further bore 72 which projects interiorly from a back face 73 of the connector block 25-5 and is located centrally between the front bores 66. The bore 72 has a center axis 74 which is disposed co-planar with the axes 67 of the bores 66. When the bore 72 is formed, also by drilling with a conventional drill bit, the diameter of the bore 72 is greater than the land 75 of material which is defined between the bores 66. As such, side portions of the bore 72 are coextensive with side portions of the bores 66 so that open areas 77 are formed between the bores 66 and 72. As a result, the bores 66 are in open communication with the bore 72 sidewardly through the open side sections 77. This allows the cabling 56 to pass rearwardly and sidewardly from the bores 66 into the bore 72.

The bore 72 has interior threads formed in the inside surface 78 thereof into which the threaded end 61 of a compression fitting 27 is threadedly engaged. This allows the cabling 56 to exit centrally through the back face 73 out of the compression fitting 27. Tightening of the compression collar 64 thereby fixedly secures the cabling 56 in place and mechanically isolates the connection of the cabling 56 and terminals 55 from exterior forces acting on the cabling 56 outside of the cable fitting 27.

Referring to FIGS. 11–14, the connector system 10 also includes a splice block assembly 80. The splice block assembly 80 is formed by a plastic splice block 81 that is sized and shaped substantially the same as the connector block 25-5. The splice block 81 includes a pair of bores 82 opening through one face 83 thereof and a single bore 84 opening through the opposite face 85 thereof. The bores 82 are formed substantially the same as the bores 66 of FIG. 10 except that the bores 82 have threaded end portions 86 which are each adapted to threadingly engage with one of the cable fittings 27. The other bore 84 is formed the same as the bore 72 of FIG. 10 and also is threadedly engaged with a cable fitting 27. The axes of the bores 82 and 84 are formed coplanar with each other so as to form open sides 88 between the bores 82 and 84. The structure and function of the open sides 88 are substantially the same as the openings 77 (FIG. 10). The splice block 80 thereby defines an interior chamber area defined by interior chambers 89 of the bores 86 and a further interior chamber 90 defined at the inner end of the bore 84. This allows cabling to extend into the splice block 81 through each of the cable fittings 27 and thereby be spliced together through a splice connection 91 in a manner as required for the audio cabling system.

Figure 15:
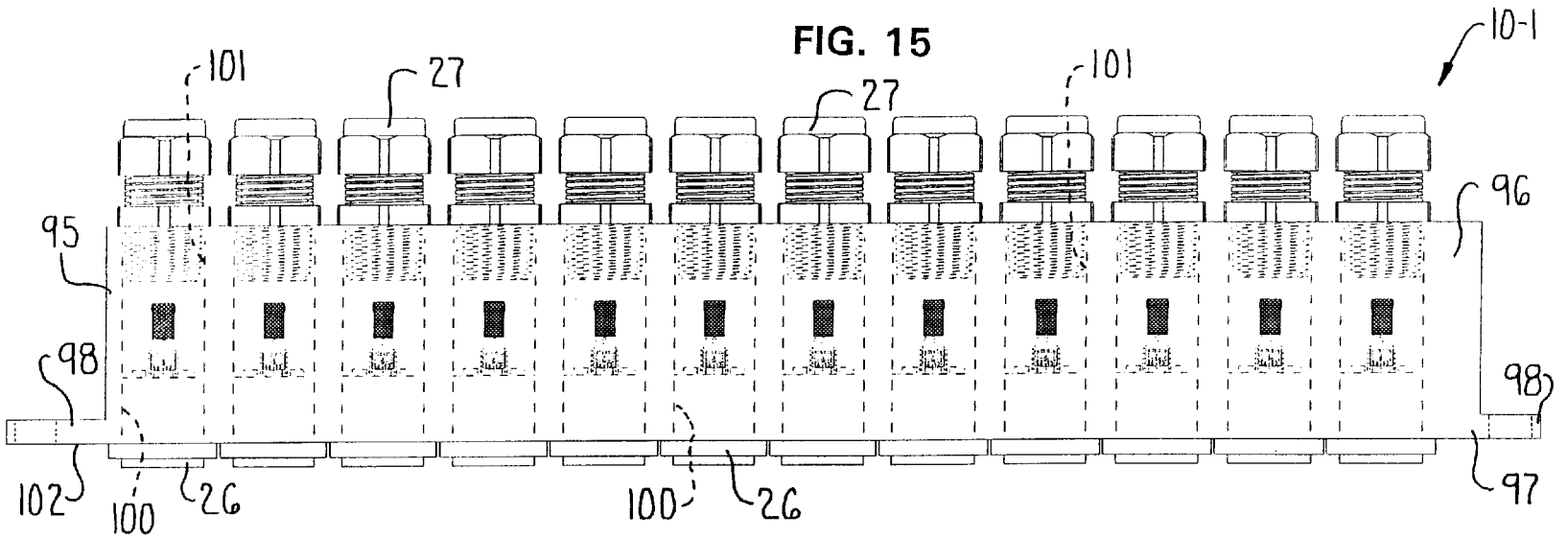
FIG. 15 is a plan view of a third type of a connector block assembly having a single row of front connector ports and a single row of rear fitting ports.
Figure 16:
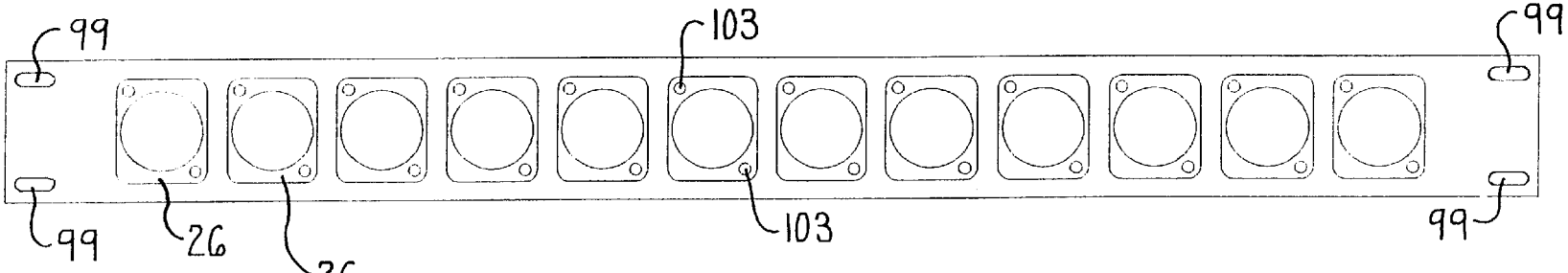
FIG. 16 is a front elevational view of the third connector block assembly.

Referring to FIGS. 15 and 16, a further embodiment of the connector system 10 of the invention is disclosed therein. In this arrangement, a single connector block unit 95 is provided which is formed as a single unitary piece defined by a connector block section 96 and a front face section 97. The front face section 97 is structurally and functionally similar to the mounting rail 12 except that the front face section 97 is formed integral with the connector block section 96 of a plastic material.

The front face section 97 includes mounting flanges 98 which project sidewardly therefrom and include pairs of fastener slots 99 which project rearwardly therethrough. The front face section 97 further includes a plurality of openings and fastener bores which are positioned in the same positional relationship as the openings 21 in the fastener holes 22 of the mounting bar 12 to thereby receive a plurality of connectors 26 therethrough.

The connector block section 96 referenced above is formed integral with the front face section 97 and thereby is sized and has a modular width which corresponds to a plurality of the separate connector blocks disclosed above in FIG. 2. More particularly, the connector block section 96 is formed with an equal number of connector ports 100 and fitting ports 101 which extend through the thickness thereof. The connector ports 100 are adapted to receive the connectors 26 therein in substantially the same manner as the connectors 26 are received, for example, within the connector ports 31 of the connector block 25. However, since the front face section 97 is formed integral with the connector block section 96, it is not necessary to clamp a separate mounting rail by the connectors 26 in the front face 102 of the front face section 97. Rather, the cable fittings 27 are provided directly in the respective fitting ports 101.

While FIG. 15 illustrates all twelve of the connector ports 100 and all twelve of the fitting ports 101 with a respective connector 26 or cable fitting 27 therein, it also will be understood that only a portion of the connector ports 100 and fitting ports 101 may be in use at a given time, the number of which depending upon the requirements for the audio system. Once the connectors 26 are fitted into the respective connector ports 100, the connectors 26 are fixedly secured in place by screws 103 which thread directly into corresponding bores formed in the plastic connector block unit 95.

Figure 17:
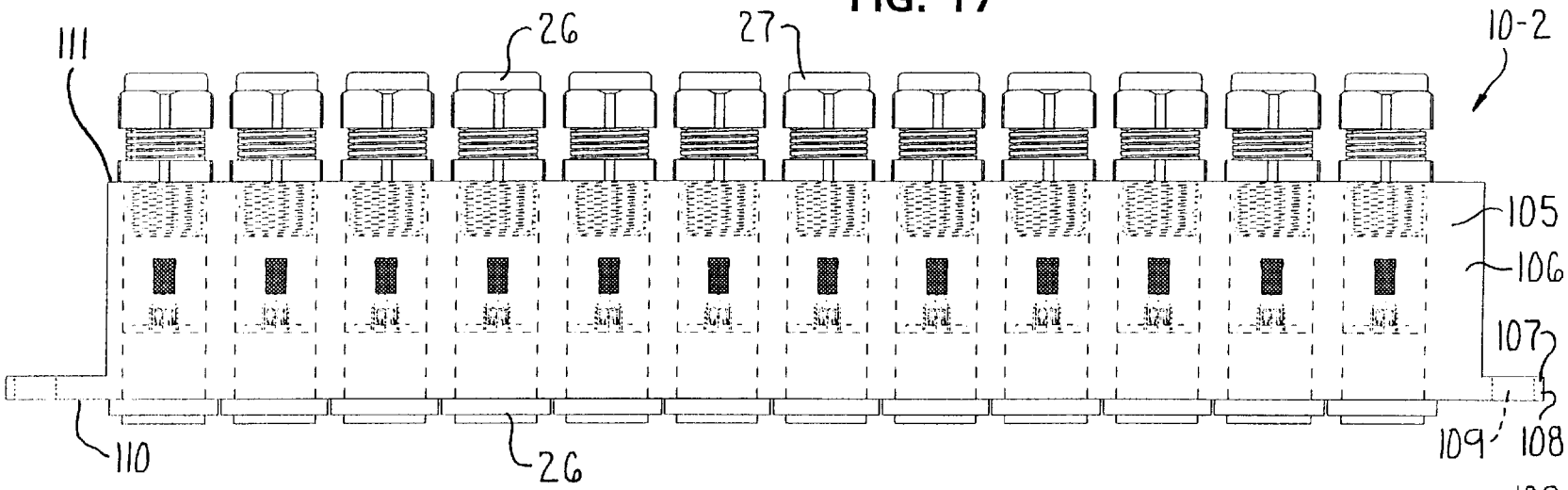
FIG. 17 is a plan view of a fourth type of connector block assembly having double rows of front connector ports and rear fitting ports.
Figure 18:
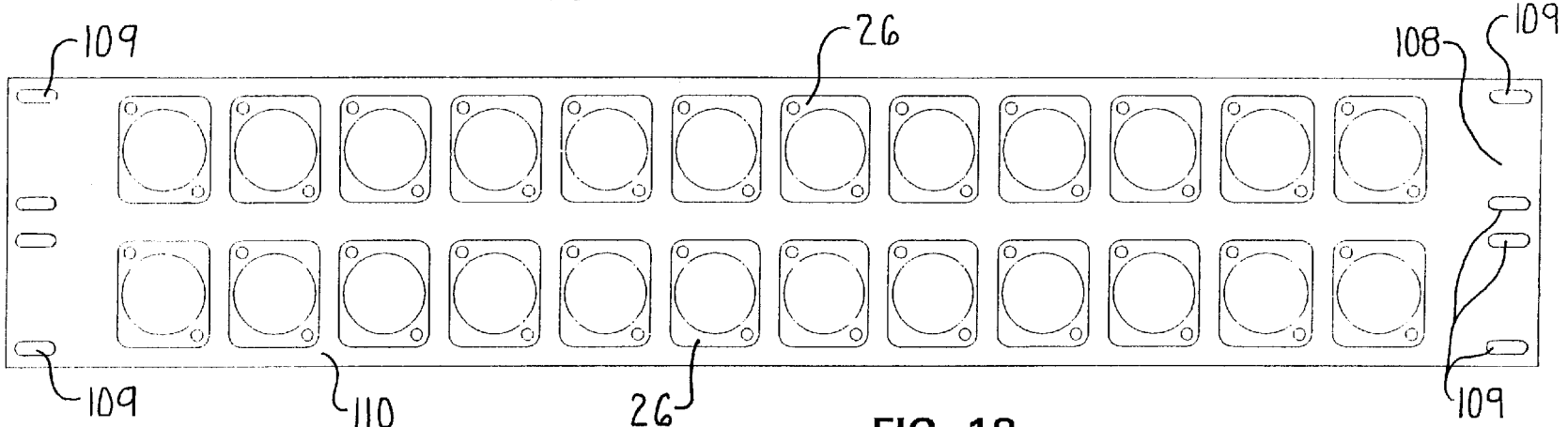
FIG. 18 is a front elevational view of the fourth connector block assembly.

Referring to FIGS. 17 and 18, FIG. 17 illustrates a further audio connector system 10-2. This arrangement is similar to the arrangement discussed above with respect to FIGS. 15 and 16.

In particular, the connector system 10-2 includes a connector block unit 105 which is formed as a single unitary piece defined by a connector block section 106 and a front face section 107. The front face section includes mounting flanges 108 through which fastener slots 109 are formed. This arrangement is formed substantially the same as the connector block unit 95 except that two rows of connectors 26 and cable fittings 27 are provided on the front and back sides 110 and 111 respectively of the connector block unit 105. Therefore, while the arrangement of FIGS. 15 and 16 is a single-row arrangement for both the connectors 26 and cable fittings 27, the embodiment of FIGS. 17 and 18 is a double-row configuration. In this double-row configuration, each connector port in which a connector 26 is received is associated with a respective fitting port in which a cable fitting 27 is received.

Figure 19:
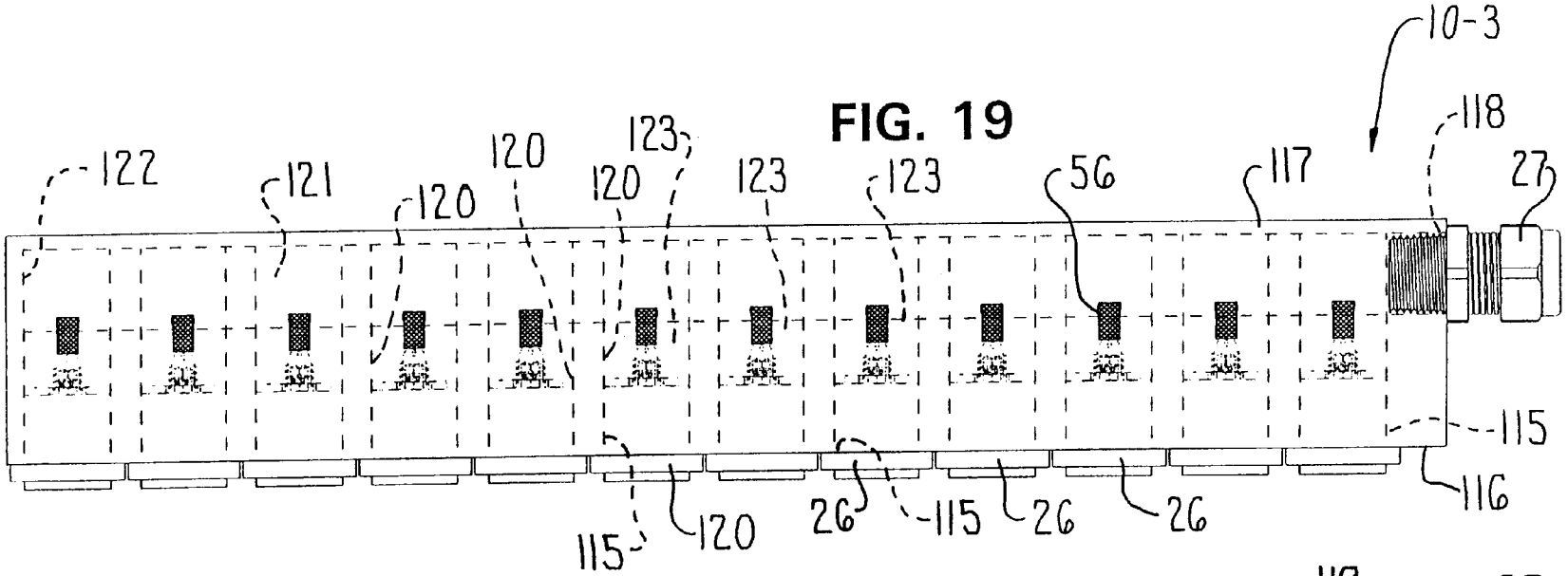
FIG. 19 is a plan view of a fifth type of connector block assembly having a single front row of connector ports and a single fitting port on the end thereof.
Figure 20:
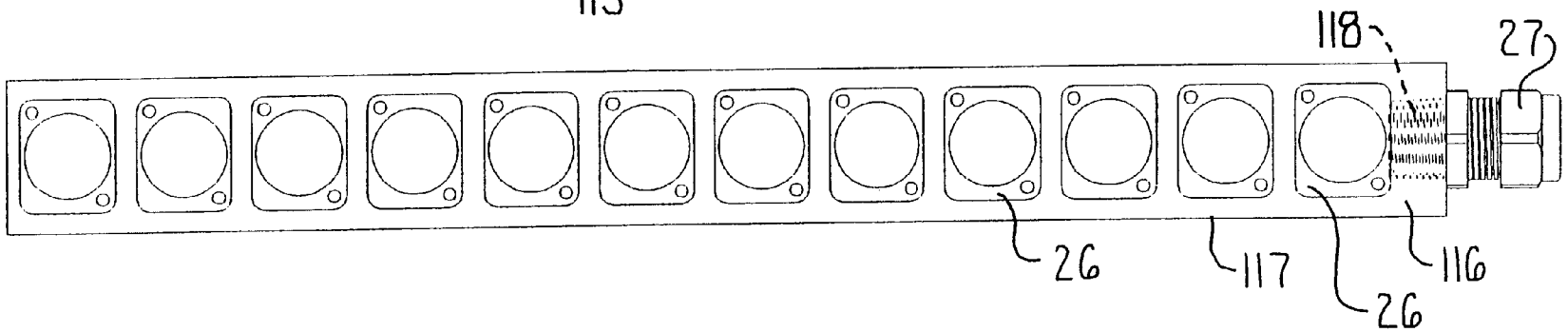
FIG. 20 is a front elevational view of the fourth connector block assembly.

A further connector system 10-3 is illustrated in FIGS. 19 and 20. This connector system 10-3 is similar to the connector block assembly of FIG. 10. In particular, the arrangement of FIGS. 19 and 20 includes multiple connector ports 115 in a front face 116 of a connector block 117, and a single fitting port 118 in which a cable fitting 27 is threadedly engaged. The arrangement of FIGS. 19 and 20, however, includes twelve connector ports 115 rather than only two in FIG. 10 and also has the fitting port 118 opening sidewardly to the right rather than rearwardly.

More particularly, each fitting port 115 is defined by a cylindrical bore 120 which extends rearwardly from the front face 116 and terminates within the interior of the connector block 117 to thereby comprise a blind bore. All of the connector bores 120 are arranged parallel to each other and have axes which are co-planar with each other. The fitting port 118 is defined by a further fitting bore 121 which extends sidewardly along almost the entire length of the connector block 117. The inner end of the fitting bore 121 terminates at an end wall 122 and therefore defines a blind bore. The axis of the fitting bore 121 also is co-planar with the axes of the connector bores 120 such that the fitting bore 121 extends through the side walls of the fitting bores 120 near the inner ends thereof. As such, each fitting bore has an open inner end 123 which opens rearwardly into the fitting bore 118 so that each connector bore 115 is in open communication therewith. This allows cabling 56 that is connected to each connector 26 to project into the fitting bore 118 and allows the cabling to be routed sidewardly through the cable fitting 27.

Figure 21:
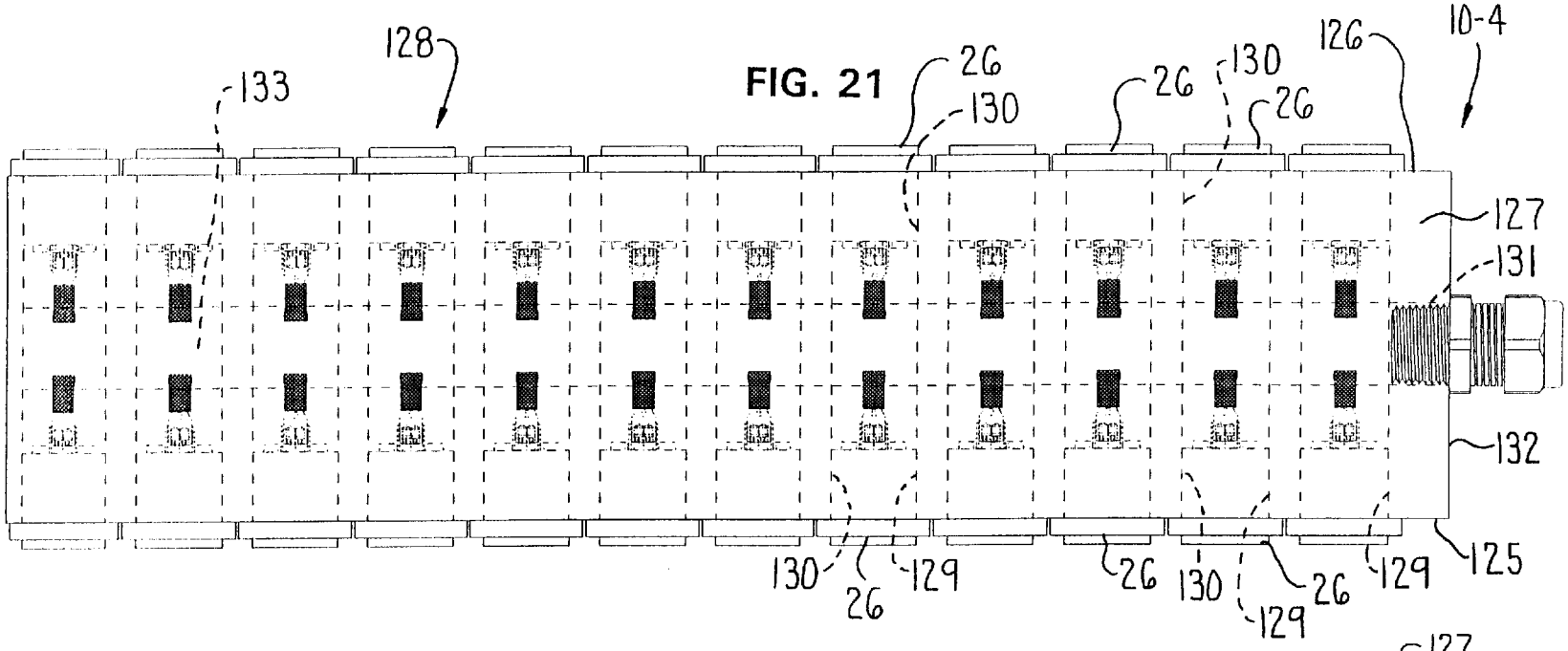
FIG. 21 is a plan view of a fifth type of connector block assembly having a row of connector ports on each of the opposite front and rear side faces thereof and a fitting port on an end face of the connector block.
Figure 22:
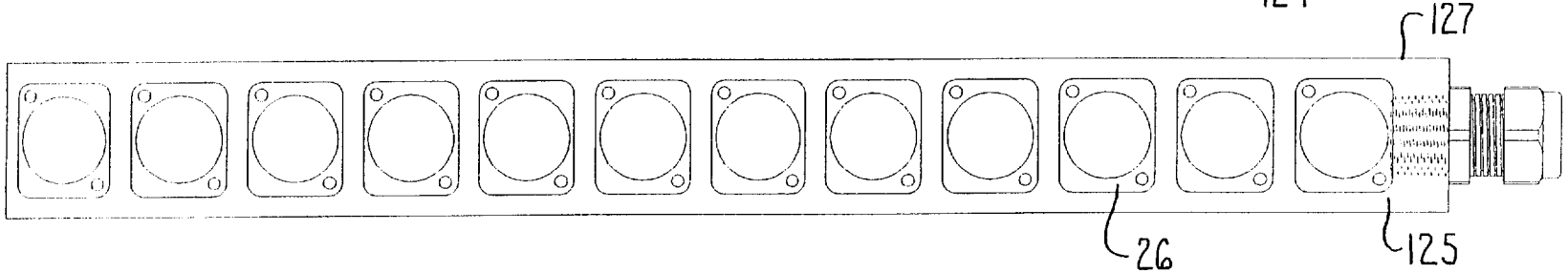
FIG. 22 is a front elevational view of the fifth connector block assembly.

Furthermore, an additional embodiment of the invention is illustrated in FIGS. 21 and 22. The connector system of this embodiment is designated by reference numeral 10-4. This arrangement is similar to the connector system 10-3 except that a row of connectors 26 is provided on each of the opposite faces 125 and 126 of a connector block 127. The connector block assembly 128 of this embodiment is formed by providing a plurality of parallel laterally spaced apart connector bores 129 which are formed entirely preferably by drilling through the thickness of the connector block 127 and thereby define a connector port 130 at each opposite end of the connector bore 129. A connector 26 may be provided in any one of the connector ports.

Additionally, a single fitting port 131 is provided in the side wall 132 of the connector block 127. The fitting port 131 is defined at an outer end of a blind fitting bore 133 which extends along a substantial portion of the length of the connector block 127. The fitting bore 133 is formed through the side walls of the connector bores 129 and therefore is in direct open communication with each of the connector ports 130 in substantially the same manner as that provided in the embodiment of FIGS. 19 and 20.

Figure 23:
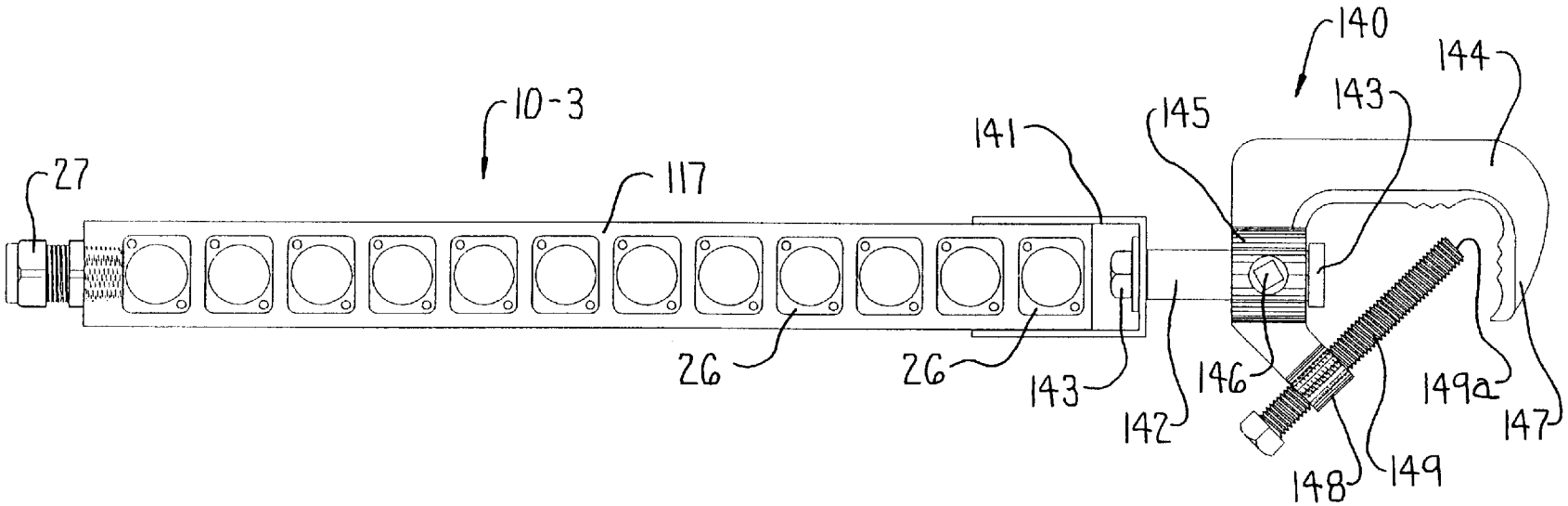
FIG. 23 is a front elevational view of a clamp-on embodiment of the connector system.

FIG. 23 is a front elevational view of the connector system 10-3 of FIG. 19 having a mounting unit 140 connected to one end of the connector block 117. The mounting unit 140 is provided in this arrangement as a clamp which allows the connector block 117 to be mounted to exterior support structures such as a table, podium or other existing structure.

The mounting unit 140 includes a U-shaped bracket 141 which is affixed to the end of the connector block 117 opposite to the cable fitting 27. The bracket 141 includes a support shaft 142 which is affixed thereto by a bolt 143 and projects outwardly therefrom. The outer end of the support shaft 142 includes a lip 143 and a fixed jaw 144 rotatably supported thereon.

The fixed jaw includes a cylindrical jaw mount 145 through which the mounting shaft 142 is rotatably received. The jaw mount 145 also includes a set screw 146 which affixes the jaw mount 145 in place on the mounting shaft 142.

The jaw 144 is L-shaped and includes a fixed jaw portion 147 that is adapted to abut against the existing support structure. The jaw 144 also has a threaded bore 148 formed therein through which a threaded bolt 149 is received. The distal end 149*a* of the threaded bolt 149 defines a movable jaw such that the fixed jaw 144 and the movable jaw 149*a* serve to clamp the connector system 10-3 onto a suitable support structure.

Figure 24:
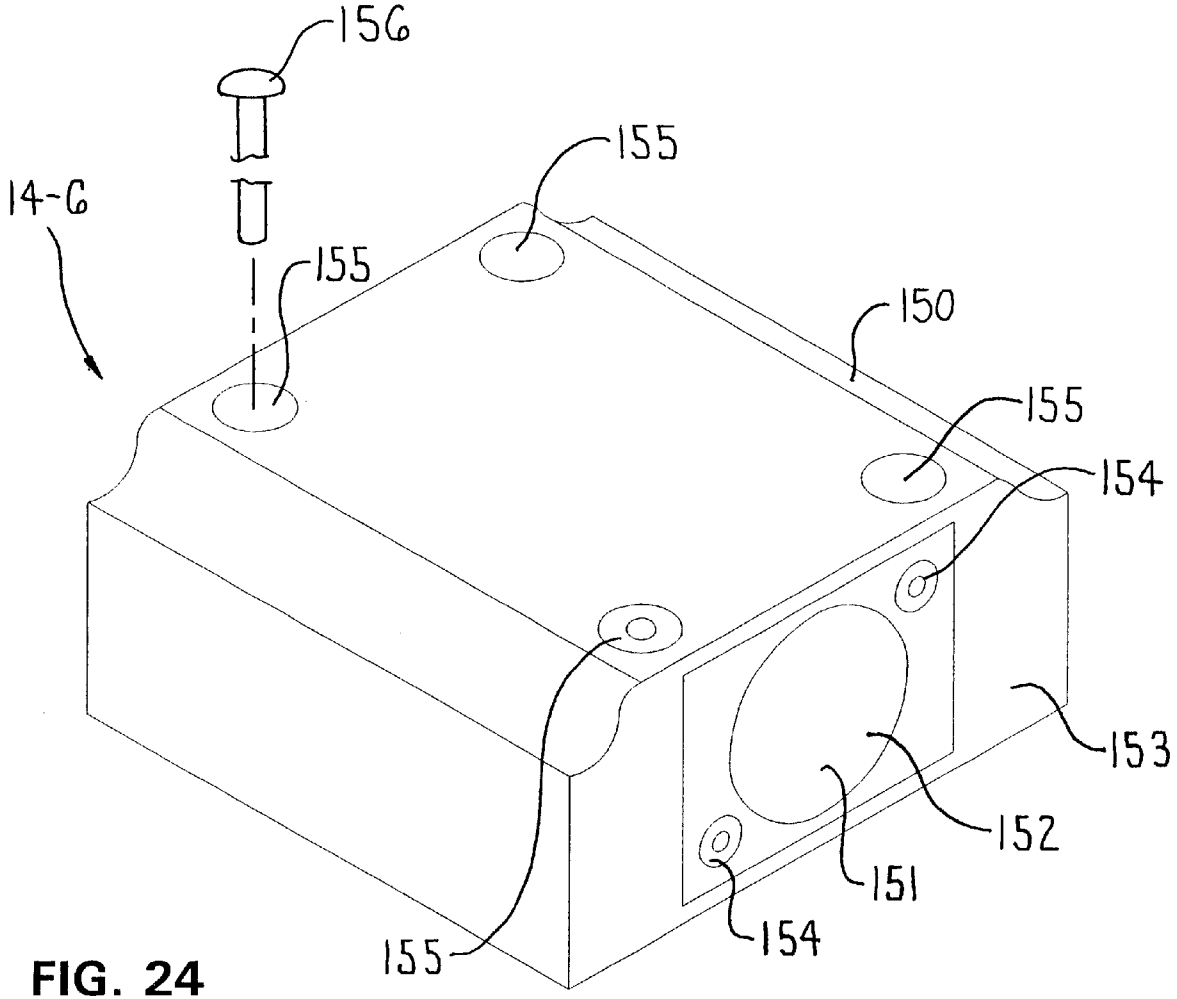
FIG. 24 is a perspective view of a sixth connector block.

Referring to FIG. 24, a further connector block assembly is identified in FIG. 24 by reference numeral 14-6. The connector block assembly 14-6 includes a connector block 150 which is a modification of the connector blocks discussed above. The connector block 150 includes a bore 151 that defines a connector port 152. The front face 153 of the connector block 150 is formed with fastener bores 154 located diagonally opposite to each other. The connector port 152 is structurally and functionally the same as the connector port 31 described above and is adapted to receive a connector 26 therein. Further discussion thereof is not required.

The connector block 150, however, has a width which is greater than the connector blocks 25-1 discussed above. The increased width allows vertical mounting bores 155 to be formed vertically therethrough. The mounting bores 155 receive conventional fasteners 156 therethrough so that the connector block 150 can be mounted to any flat surface, whether such surface is defined by a bottom or top surface of a table top, podium top or even a vertical wall surface. Additionally, the connector block 150 also may be mounted to a support rail using the techniques described herein relative to FIGS. 4, 28 and 29.

Figure 27:
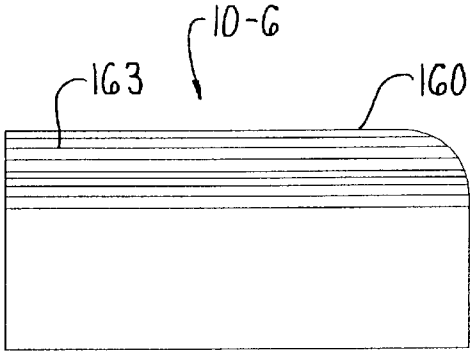
FIG. 27 is a side elevational view of the seventh connector block.
Figure 25:
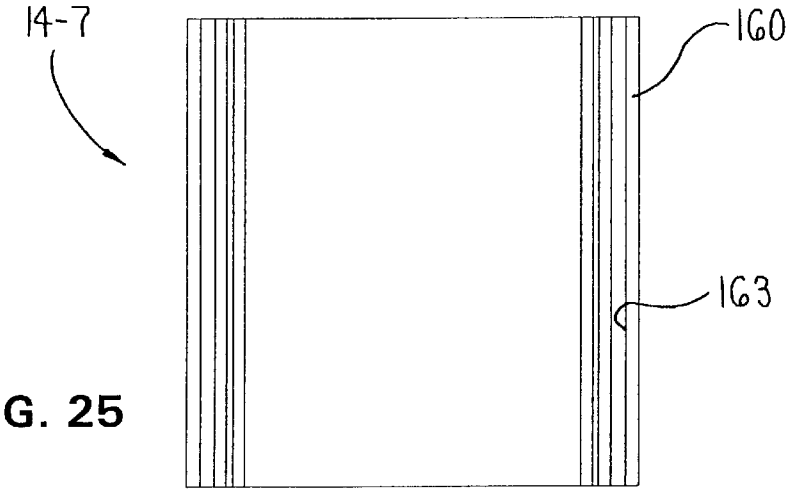
FIG. 25 is a plan view of a seventh connector block.
Figure 26:
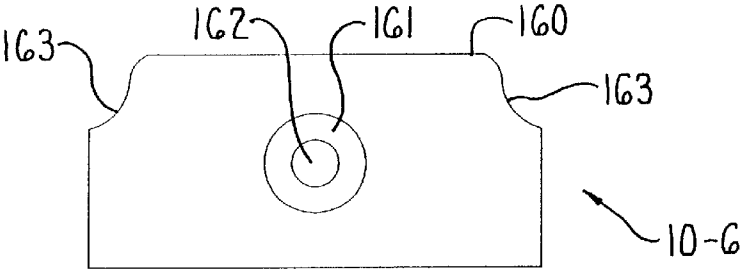
FIG. 26 is a front elevational view of the seventh connector block.

Referring to FIGS. 25–27, a further connector block assembly is designated by reference numeral 14-7. This connector block arrangement includes a connector block 160 which is structurally and functionally substantially the same as the connector block 150 described above except that separate mounting bores 155 are not formed therein. Rather, the connector block 160 includes a connector port 161 on a front side thereof and a fitting port 162 formed on a back side thereof. The connector block 160 is formed with contoured corners 163 and may be formed of any aesthetically pleasing material such as a solid block of wood. As such, this connector block arrangement 10-6 may be used by itself on any available surface in a visible location and does not require structural fastening to the surface.

Figure 28:
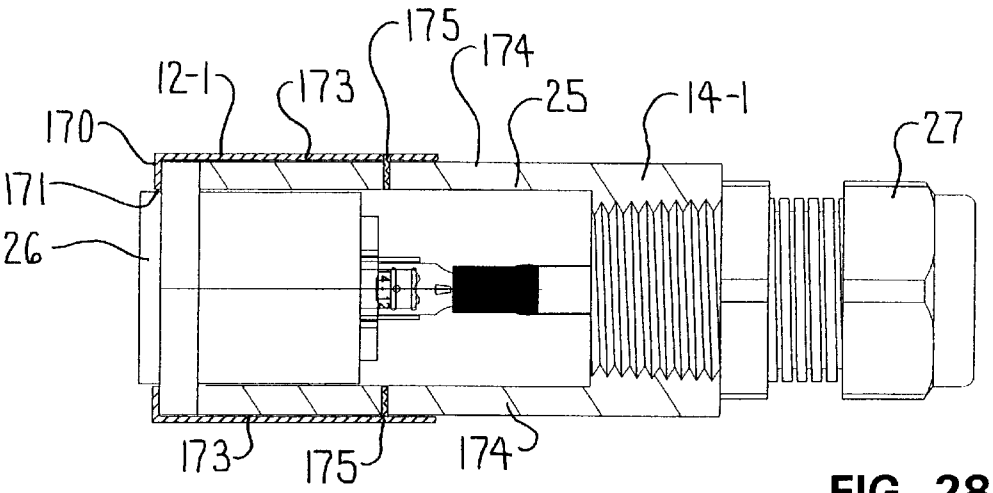
FIG. 28 is a side cross-sectional view of a modified version of the connector block arrangement of FIG. 4.

Referring to FIG. 28, the connector block arrangement illustrated therein utilizes the same components as the connector block assembly 14-1 described above. The connector block assembly 14-1 includes a connector block 25 having a fitting 27 on one end thereof and a connector 26 on the opposite end thereof. Moreover, a modified mounting rail 12-1 is provided. The mounting rail 12-1 includes a front wall 170 which is formed with at least one mounting hole 171 therein. Preferably, the front wall 170 includes an array of mounting holes 171 in the same pattern as the mounting holes 21 discussed above.

The mounting rail 12-1 also includes expanded side walls 173 which project rearwardly from the front wall and surround a substantial portion of the opposing faces 174 formed on the connector block 25. Additionally, threaded fasteners 175 are threaded through the side walls 173 and into the material of the connector block 25. Thus, the connector block 25 can be inserted into the space between the side walls 173 with the connector 26 already attached thereto. Thereafter, the fasteners 175 are threaded therein.

Figure 29:
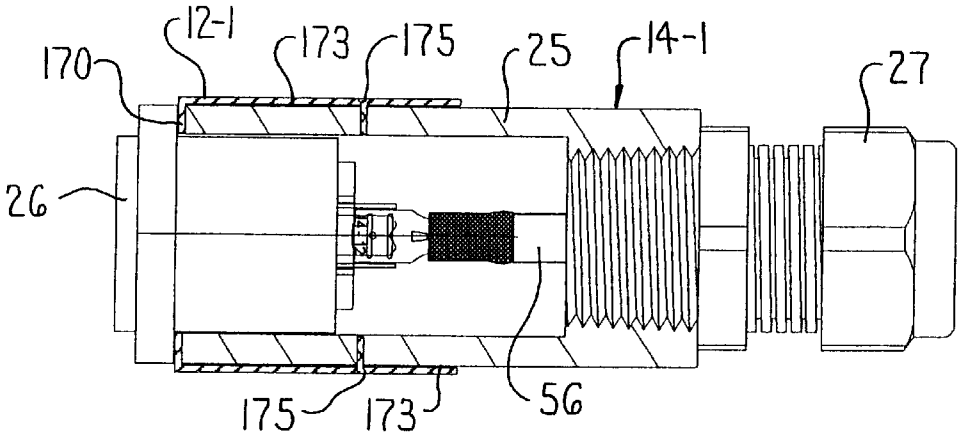
FIG. 29 is a further modification of the arrangement of FIG. 28.

Referring to FIG. 29, alternatively, the same arrangement of the connector assembly 14-1 can be modified by first inserting the connector block 25 into the mounting rail 12-1 and then inserting the fasteners 175 through the side walls 173. Thus, the connector block 25 is stationarily affixed to the mounting rail 12-1. Thereafter, the cabling 56 can be threaded rearwardly through the connector block 25 and through the compression fitting 27 with the connector 26 attached to the cabling 56. The connector 26 is then inserted into position in the connector block 25. This arrangement allows the connector block 25 to remain supported within the mounting rail 12-1 even when the connector 26 is removed, for example, to change the connector 26 to a different type of connector.

Figure 30:
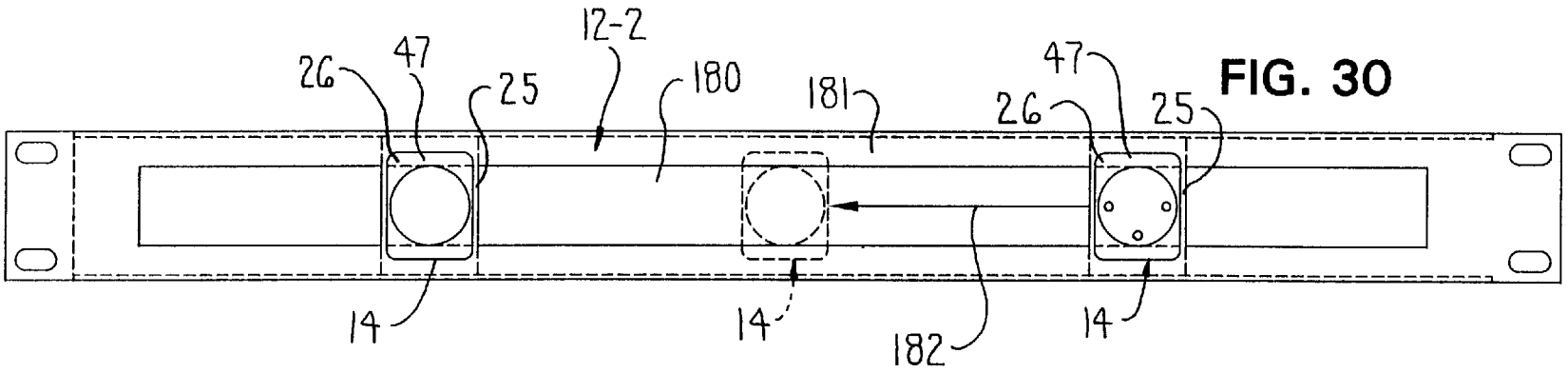
FIG. 30 is a front elevational view of connector block assemblies mounted to a slotted mounting rail.

Referring to FIG. 30, a further connector system is illustrated having a modified mounting rail 12-2 therein. The mounting rail 12-2 is formed substantially the same as the mounting rail 12 discussed above relative to FIG. 2. However, rather than a row of openings 21 being provided, instead, a horizontally elongate slot 180 is provided in the front wall 181 of the mounting rail 12-2.

The vertical dimension of the horizontal slot 180 corresponds to the diameter of the opening 21 so that a plug connector 26 may be inserted therethrough into engagement with a connector block 25. The connection of the block 25 and plug connector 26 to the mounting rail 12-2 has the same cross-sectional appearance as FIG. 1. In particular, the front wall 181 of the mounting rail 12-2 is confined between the front face of the connector block 25 and the back face of the flange 47 formed on the plug connector 26. Therefore, while each connector assembly 14 is confined and mounted on the mounting rail 12-2 in the same manner that the connector assemblies 14 are mounted to the mounting rail 12, the mounting rail 12-2 does not confine each connector assembly 14 laterally. As a result, the connector assemblies 14 may be slid laterally along the slot 180 to adjust the position thereof.

For example, the rightward connector assembly 14 may be slid leftwardly as indicated by reference arrow 182 to the alternate position illustrated in phantom outline in FIG. 30. At the same time, the slot 180 also has a lateral width which generally corresponds to the length of the row of openings 21 in FIG. 3 so that the length of the slot 180 has a modular magnitude. This allows the same arrangement of connector assemblies 14 through 14-4 to be mounted to the mounting rail 12-2 in the same manner that these connector assemblies are mounted to the rail 12 as seen in FIG. 2. The mounting rail 12-2, however, has the added flexibility of permitting lateral sliding of the connector assemblies 14 for positioning in non-modular positions. This arrangement of the mounting rail 12-2 would be preferred over the mounting rail 12 due to the flexibility provided thereby.

Figure 31:
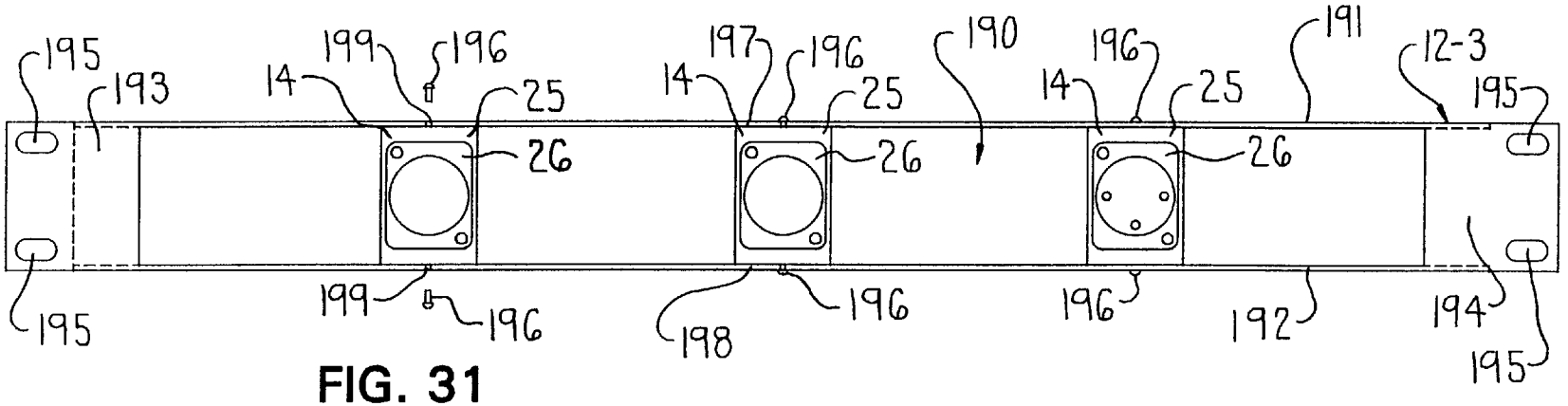
FIG. 31 is a front elevational view of connector block assemblies mounted to a second type of slotted mounting rail.

Referring to FIG. 31, a further alternate mounting rail 12-3 is illustrated which is similar to the mounting rail 12-2 except that a slot 190 therein has a greater vertical dimension.

In particular, the slot 190 extends vertically between upper and lower flanges 191 and 192. The flanges 191 and 192 extend laterally and are rigidly connected to front wall sections 193 and 194, which front wall sections include mounting holes 195 in the corners thereof. The upper and lower flanges 191 and 192 are adapted to slidably receive a plurality of connector block assemblies 14 therebetween. These connector block assemblies 14 are fixed in place by fasteners 196 which are threadedly engaged into the connector blocks 25 of each connector block assembly 14.

More particularly, each flange 191 and 192 includes a row of laterally spaced apart fastener holes which extend vertically through the flanges 191 and 192. Each hole is adapted to receive a fastener 196 therethrough in substantially the same manner as the fasteners 175 illustrated in FIG. 28. Since a front wall section is omitted from the area of the slot 190, the connector block assemblies 14 may be oriented with the connectors 26 facing forwardly therefrom as illustrated in FIG. 31. Alternatively, a connector block assembly 14 also may be reversed so that the connector 26 faces rearwardly. With this arrangement, the fasteners 196 may still be threadedly engaged through the flanges 191 and 192 into threaded engagement with the side surfaces 197 and 198 of the connector block 25.

Since a row of the apertures 199 are provided, the connector block assemblies 14 may be positioned adjacent to any vertically aligned pair of apertures 198 and secured in place by the fasteners 196. Therefore for the arrangement illustrated in FIG. 31, three of the fastener holes 199 corresponding to each connector block assembly 14 are in use, while additional apertures disposed between or outwardly of the connector block assemblies 14 remain unused yet are still available for use with additional connector block assemblies 14.

Also, any of the illustrated connector block assemblies 14 may be unfastened from the mounting rail 12-3 by removal of the fasteners 196 corresponding thereto. This allows the connector block assembly 14 to either be slid sidewardly to a new lateral position associated with unused fastener holes 199 or else rotated 180 degrees about a vertical axis so that the connector 26 faces rearwardly. This mounting rail 12-3 also is preferred over the mounting rail 12 referenced above.

Another aspect of the invention is that the above-described components may be provided as a kit of modular components primarily with respect to FIGS. 1–10, a mounting rail 12 may be provided with a combination of single-port and multiple-port connector block assemblies 14. The connector block assemblies can be sold in combinations of single-port and multiple-port connector blocks 25 in combination with a suitable number of identical cable fittings 27 and any desirable combination of audio connectors 26. The multiple-port connector block assemblies 14 such as 14-2, 14-3, 14-4 and 14-5 may be selected to group associated audio connectors 26 together into a single connector block 25, while the single-port connector block assemblies 14-1 may be used for stand alone audio connectors 26. Additionally, once the various sized connector block assemblies 14 are mounted on a mounting rail 12, the connector block assemblies 14 also may be removed and replaced with alternate types or combinations of connector block assemblies. For example, a triple-port connector block assembly 14-3 may be replaced with a double-port connector block assembly 14-2 and a single-port connector block assembly 14-1 or even three single-port connector block assemblies 14-1. Furthermore, it also is possible to use different types of connector blocks such as the double-port, single-fitting connector block assembly 14-5.

In addition to the foregoing, for larger arrangements of connectors 26, the connector systems 10-1, 10-2, 10-3 and 10-4 of FIGS. 15–22 may also be provided.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A plug connector system for audio, video or power systems comprising:

a support structure;

a mounting rail having a support flange fixedly connected to said support structure and a plurality of openings in longitudinally spaced relation; and at least one connector assembly mounted to said mounting rail, said connector assembly including a connector block having at least one connector port which opens through a first face and is positioned in registry with a corresponding one of said openings in said mounting rail, said connector block assembly further including a plug connector which includes a connector housing that is insertable through a respective one of said openings in said mounting rail and extends into said connector port, said plug connector further including a mounting flange which projects outwardly of said housing, said mounting flange abutting against a front face of said mounting rail wherein said mounting rail is confined between said mounting flange and said first face of said connector block, and said connector block assembly including a fastener arrangement which joins said plug connector to said connector block in fixed relation such that said connector block is fixedly supported on said mounting rail, said connector port defining an interior chamber inwardly of said connector housing which is in open communication with a fitting port defined within said connector block, said fitting port opening through a second face of said connector block and including a cable fitting therein, a cable being provided which extends through said cable fitting in fixed securement therewith and has a terminal end connected to said connector by a cable connection which is confined within said interior chamber of said connector bore.

2. The plug connector system of claim 1, wherein said cable fitting is a compression fitting which fixedly engages said cable.

3. The plug connector system according to claim 1, wherein said first face of said connector block includes fastener bores and said mounting rail includes fastener holes proximate said connector openings, said connector mounting flange including fasteners which project from said mounting flange through said fastener holes into fixed engagement with said fastener bores of said connector block such that said mounting rail is clamped between said first block face and said mounting rail.

4. The plug connector system according to claim 3, wherein said connector block is formed of a rigid plastic material and has said connector port and said fitting port disposed in coaxial alignment so as to extend through said connector block, said fitting port being threaded so as to be threadedly engaged with said cable fitting.

5. The plug connector system according to claim 4, wherein said connector assembly includes a plurality of said connector ports which open through said first face, each said cable port being aligned with a corresponding one of said openings in said mounting rail and having one said audio connector engaged therewith.

6. The plug connector system according to claim 1, wherein said connector assembly includes a plurality of said connector ports which open through said first face, each said cable port being aligned with a corresponding one of said openings in said mounting rail and having one said connector engaged therewith.

7. The plug connector system according to claim 6, wherein said connector block includes a plurality of said connector ports, each said connector port being in open communication with a corresponding one of said cable ports and each said connector has a said cable connected thereto which is fixedly connected to said cable fitting associated therewith.

8. The plug connector system according to claim 6, wherein said fitting port is in open communication with each of said connector ports and each said connector has a said cable connected thereto which exits through said fitting port.

9. An plug connector system having a plug connector assembly, said plug connector assembly comprising:

a connector block having a unitary body of insulative material, said connector block including a first face and a plurality of connector bores which each extend into said connector block and have an open end which opens through said first face to define a connector port, said connector block further including at least one fitting bore which extends into the body of said connector block and has an inner section which is in open communication with at least a respective one of said connector bores, said fitting bore having an open end which opens through a second face of said connector block to define a fitting port;

a plurality of plug connectors, each of said plug connectors having a connector housing which fits into a respective one of said connector ports in fixed engagement therewith, said connector housing further including a connector terminal which is enclosed within said connector bore and is connected to a terminal end of a cable adapted for audio, video or power; and a cable fitting which is fixedly engaged in one said fitting port therethrough, said cable fitting being removably fixedly engaged with each said cable extending therethrough, said cable extending into a respective one of said connector bores wherein said distal end and said terminal are fully enclosed by said connector block and said cable fitting prevents movement of said cable relative thereto.

10. The plug connector system according to claim 9, wherein a plurality of said fitting bores are provided in a single row, each said fitting bore being in open communication with a respective one of said connector bores.

11. The plug connector system according to claim 9, wherein said connector block includes mounting flanges projecting outwardly therefrom that include mounting parts which permit connection of said audio connector assembly to support structure.

12. The plug connector system according to claim 9, wherein said fitting bore is in open communication with a plurality of said connector bores and a plurality of said cables are provided which extend through said fitting bore, each said cable being connected to a respective one of said connectors.

13. The plug connector system according to claim 12, wherein said fitting bore is in open communication with all of said connector bores and all of said cables of said connectors extend through said fitting bore.

14. The plug connector system according to claim 12, wherein each of said connector bores has a central axis, said central axes of said connector bores lying in a common plane such that said connector bores are arranged in a single row.

15. The plug connector system according to claim 9, wherein said connector bores are arranged in laterally spaced relation in a single row.

16. The plug connector system according to claim 15, wherein a single said fitting bore is provided which extends laterally and intersects with each of said connector bores so as to be in open communication therewith.

17. A plug connector system defined by a kit of components, said components comprising:

at least one single-port plug connector assembly comprising a single-width connector block having a first width, said single-width connector block including a connector port in a first face in which a plug connector is fixed and a fitting bore in which a cable fitting is fixed, said single-port connector assembly further including a cable having a distal end which is enclosed within said connector block and is connected to a terminal on said plug connector, said cable being fixedly secured to said cable fitting;

one or more multi-port connector assemblies, each of said multi-port connector assemblies having a multiple-width connector block having a second width which is a multiple of the first width so that said multi-port plug connector assembly has a modular width, said multi-port connector block having a plurality of connector ports, the number of which corresponds to said multiple of said first width, each said connector port including a plug connector therein, and each of said plug connectors being connected to a respective cable which extends out of said connector block through at least one fitting port that includes a cable fitting therein which said cable fitting is fixedly connected to each said cable extending through said fitting port.

18. The plug connector system according to claim 17, wherein at least one of said multiple-width connector blocks is a double-width connector block, the width of which is double the first width, and at least one of said multiple-width connector blocks is a triple-width connector block, the width of which is three times the first width.

19. The plug connector system according to claim 17, which includes a mounting rail having a plurality of openings therethrough, said openings being in laterally spaced relation so as to permit said connectors of said single-port and multi-port plug connector assemblies to be accessible through successive laterally adjacent openings wherein said single-port plug connector assembly is disposed directly adjacent to at least one said multi-port connector block assembly.

20. The plug connector system according to claim 19, wherein each said audio connector includes a mounting flange which projects outwardly therefrom and abuts against a first face of said mounting rail wherein said respective connector block in which said plug connector is supported abuts against an opposite second face of said mounting rail, said plug connector including a fastener structure which fixedly joins said mounting flange to said respective connector block so that said mounting rail is confined therebetween.

* * * * *